United States Patent [19]

Heck

[11] 4,020,560

[45] May 3, 1977

[54] BOW SIGHTS AND METHODS OF MAKING AND USING THE SAME

[76] Inventor: Albert Heck, 1131 Grand Prix, St. Charles, Mo. 63301

[22] Filed: Apr. 7, 1975

[21] Appl. No.: 565,650

[52] U.S. Cl. ..... 33/265

[51] Int. Cl.[2] ..... F41G 1/00; F41B 5/00

[58] Field of Search ..... 33/265

[56] References Cited

UNITED STATES PATENTS

| | | | |
|---|---|---|---|
| 3,579,839 | 5/1971 | Kowalski | 33/265 |
| 3,800,424 | 4/1974 | Saunders et al. | 33/265 |
| 3,822,479 | 7/1974 | Kowalski | 33/265 |
| 3,849,894 | 11/1974 | Brougham | 33/265 |
| 3,854,217 | 12/1974 | Killian | 33/265 |
| 3,871,105 | 3/1975 | Brougham | 33/265 |

*Primary Examiner*—William D. Martin, Jr.
*Attorney, Agent, or Firm*—Polster and Polster

[57] ABSTRACT

A bow sight for use with archery bows comprising mounting means adapted to mount the sight on the bow, a sighting member operably mounted on said mounting means and adjusting means mounted on said mounting means so as to control the transverse and vertical movement of the sighting member.

7 Claims, 9 Drawing Figures

BOW SIGHTS AND METHODS OF MAKING AND USING THE SAME

BACKGROUND OF THE INVENTION

A need exists for a simple reliable and economical bow sight for use with archery bows. Those devices available in the prior art are generally lacking in flexibility in features which allow quick adjustment under field conditions.

SUMMARY OF THE INVENTION

In the present invention a device is contemplated which in its preferred embodiment is intended for use by archery enthusiasts and comprises a sight member which is adjustably mounted on the bow and is provided with means for quickly and reliably adjusting the lateral and vertical position of the sight member.

It is therefore a primary object of the invention to provide a bow sight which is simple, reliable and economically manufactured.

It is a further object to provide such a device which includes means for rapid change of sight member for right and left handed shooters.

It is a further object to provide such a device with rapid adjustment and automatic locking of the position of the sight member.

With the above primary and other incidental objects in view which will more fully appear in the specification of the invention which is provided herein, the invention intended to be protected by Letters Patent consists of the features of construction of the parts and combinations thereof, and the mode of operation hereinafter described or illustrated in the accompanying drawings, or their equivalents.

BRIEF DESCRIPTION OF THE DRAWINGS

Referring to the drawings, wherein is illustrated a preferred but not the only form of embodiment of the invention.

DETAILED DESCRIPTION OF THE INVENTION

Figure 1:
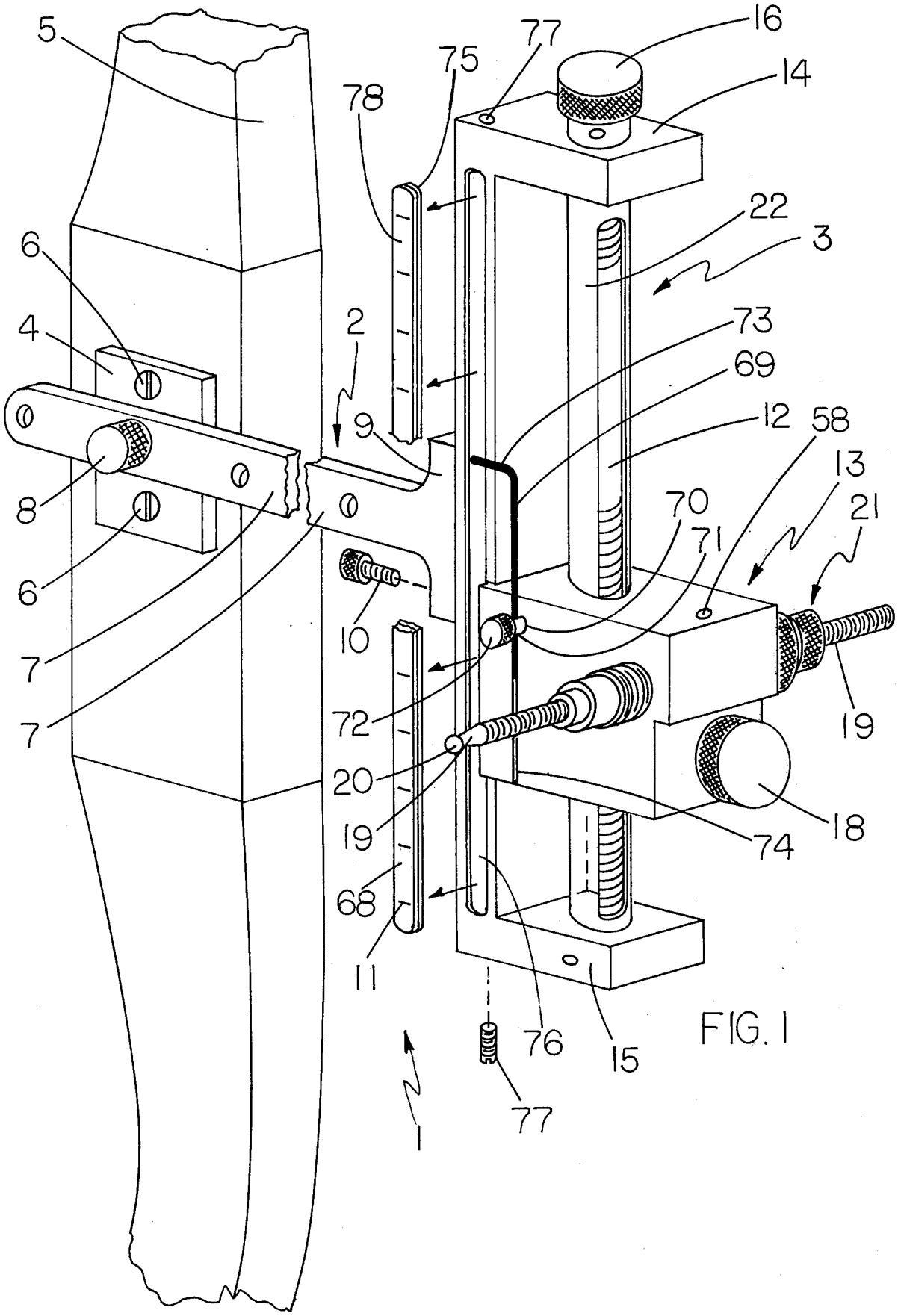
FIG. 1 is a perspective elevation view of a bow sight constructed in accordance with and embodying the present invention.

Referring now to the drawings and in particular to FIG. 1, the bow sight, 1, is shown in elevation to comprise primarily of the support structure, 2, and the sight assembly, 3. The support structure, 2, comprises bracket, 4, which is secured to bow, 5, by means of fasteners, 6, and elongated member, 7, which is mounted on bracket, 4, by fasteners, 8. Elongated member, 7, is provided with mounting bracket, 9, to which is attached, sight assembly, 3, by means of fasteners, 10.

Sight assembly, 3, includes housing, 11, lead screw means, 12, and sighting block, 13. Housing, 11, is provided with flanges, 14, and, 15, at the upper and lower ends respectively. Lead screw housing, 22, is mounted between brackets, 14, and, 15, and lead screw, 12, is disposed within housing, 22, and its rotation is controlled by knurled knob, 16, which is secured to the upper end of lead screw, 12. Lead screw, 12, passes through sighting block, 13, and engages threads therein in such a manner that rotation of lead screw, 12, in one direction causes block, 13, to rise and rotation in the opposite direction causes block, 13, to descend. The vertical position of block, 13, may be secured or clamped by locking means, 17, which is controlled by knurled knob, 18. Locking means, 17, is shown in greater detail in FIG. 2.

Figure 2:
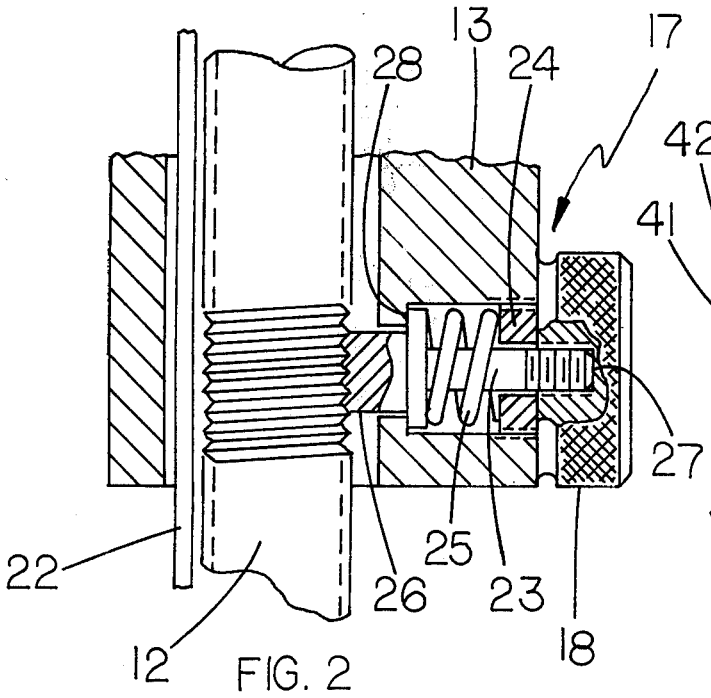
FIG. 2 is a partial sectional view of a part of the sight assembly used in the device shown in FIG. 1.

FIG. 2, describes in greater detail the vertical control of sighting rod, 19. As shown in FIG. 2, plunger, 23, is connected to knob, 18, by screwing its threaded end, 27, into knob, 18, while the other end of plunger, 23, is provided with threaded rack, 26, which engages lead screw, 12. Spring, 25, is disposed about plunger, 23, and between stop block, 24, mounted in a passage in the block, 13, and the shoulder of rack, 26. When coarse vertical adjustment is desired, knob, 18, is pulled out thus disengaging rack, 26, from lead screw, 12. Fine adjustment of the vertical position of block, 13, is obtained by rotating lead screw, 12, by rotating knob, 16, which engages rack, 26, which is restrained from rotating.

The transverse position of sighting rod, 19, with sight marker, 20, on an end thereof, is controlled by assembly, 21. Assembly, 21, is shown in greater detail in FIG. 3.

Figure 3:
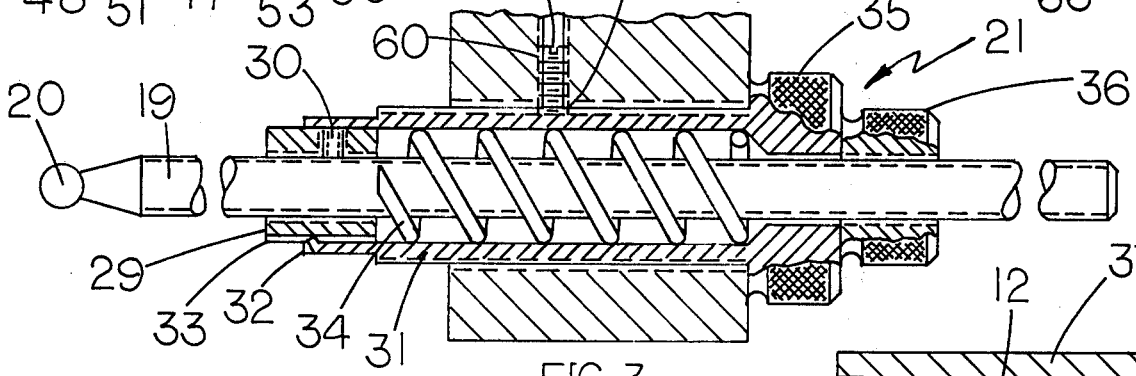
FIG. 3 is a partial sectional view of a part of the sight assembly used in the device shown in FIG. 1.

As shown in FIG. 3, the sighting rod, 19, passes through a passage in a bushing, 29, and is locked in position therein by lockscrew, 30. The threads on sighting rod, 19, engage knob, 36, which is the control for transverse travel of rod, 19. Housing, 31, is provided with tab, 32, which engages the groove, 33, in bushing, 29, and prevents the bushing from turning when knob, 36, is rotated. Housing, 31, is also provided with a chamber in which spring, 34, is disposed and surrounds rod, 19, and a knob, 35, shown in this embodiment as integral with a housing 31, mounted in block, 13. The knob, 35, is used as a finger grip in mounting the housing, 31, in the block. The spring 34 is caged and compressed between the bushing, 29, and an internal annular shoulder in the housing 31. Fine transverse adjustment of rod, 19, is obtained by simply rotating knob, 36. For coarse adjustment, marker, 20, is pushed slightly by hand towards block, 13, thus reducing the binding of knob, 35, on knob, 36, caused by spring, 34, pushing bushing, 29, towards marker, 20. Then knob, 36, is easily rotated away from or towards block, 13, and then the pressure on marker, 20, is removed.

Figure 5:
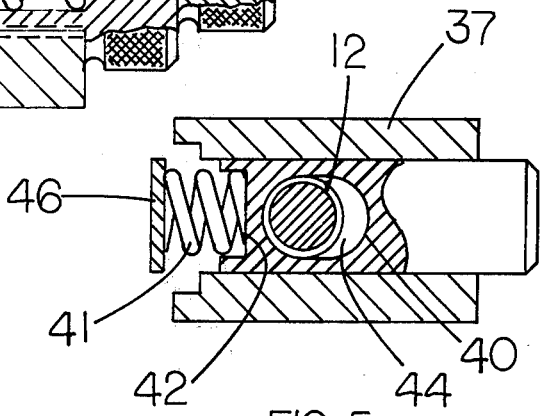
FIG. 5 is another view of the device shown in FIG. 4.
Figure 4:
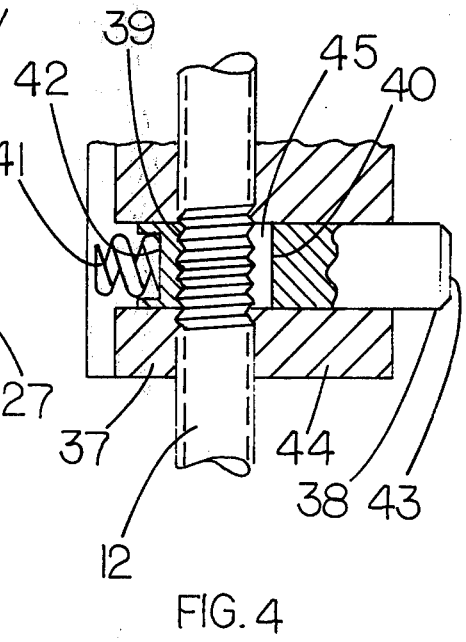
FIG. 4 is a partial sectional elevation view of an alternate embodiment of part of the sight assembly used in the device shown in FIG. 1.

FIG. 4 and FIG. 5 show an alternate configuration for the vertical adjustment. Block, 13, is modified slightly and becomes block, 37. In this configuration housing, 22, is eliminated and lead screw, 12, passes through hole, 44, in block, 37, and through a hole, 45, in a rack block part of a push rod, 38. Hole, 45, in rod, 38, is irregular in that a portion thereof, 39, is threaded while the other portion, 40, has the threads removed, or equivalent. Without pressure on rod, 38, spring, 41, engaging shoulder, 42, in rod, 38, forces engagement of the threaded portion, 39, with lead screw and rotation of screw, 12, causes block, 37, to move vertically, thus the fine adjustment. For coarse adjustment, rod, 38, is pushed on its end, 43, causing threaded portion, 39, to disengage from screw, 12, and allowing easy movement of block, 37. The configuration shown in FIG. 4 and FIG. 5 may be further complemented by attaching shoe, 46, to the base of spring, 41, to facilitate the sliding contact with housing, 11.

Figure 6:
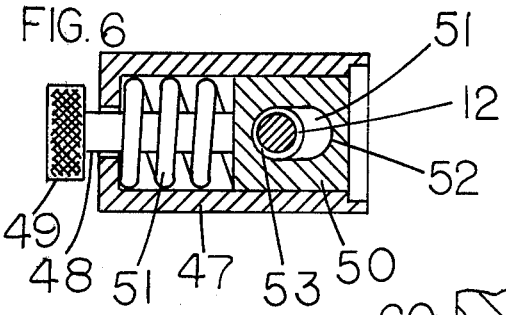
FIG. 6 is a partial sectional elevation view of an alternate embodiment of part of the sight assembly used in the device shown in FIG. 1.

FIG. 6 shows essentially the inverse to that shown in FIG. 4 and FIG. 5. Block, 37, becomes block, 47, again the block, 47, is provided with hole, 51, which is threaded on one side, 53, and smooth on the other side, 52. Spring, 51, keeps rack, 50, engaged with lead screw, 12, except when coarse adjustment is desired in which case knob, 49, is pulled out disengaging rack, 50, which is attached to knob, 49, by shaft, 48.

Figure 7:
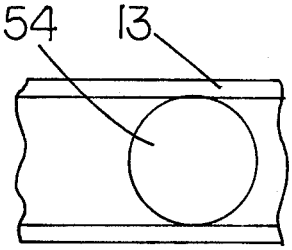
FIG. 7 is a plan view of a part of the sight assembly used in the device shown in FIG. 1.
Figure 8:
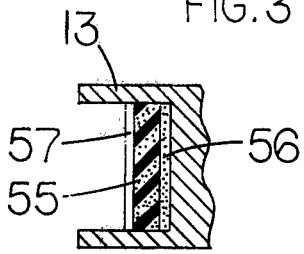
FIG. 8 is another view of the part shown in FIG. 7.

A further modification to block, 13, may improve performance is shown in FIG. 7 and FIG. 8. Block, 13, is provided with circular recess, 54, into which synthetic sponge, 55, is disposed and secured to block, 13, by adhesive, 56. Paper, 57, is provided and secured to sponge, 55, to provide smooth and uniform contact with housing, 11.

Another feature which is optional is shown in FIG. 1 and FIG. 3. In this arrangement, housing, 31, is provided with peripheral slot, 59. Threaded hole, 60, is then provided in block, 13, into which set screw, 58, enters, locking housing, 31, in place. This is a significant feature. It is contemplated that housing, 31, may be reversed by simply unscrewing from block, 13, and inserting from the other side thus allowing quick change from right to left handed shooters. To prevent movement of housing, 31, in this configuration, set screw, 58, is used. It is also contemplated that this device may be made so that housing, 31, is integral with block, 13, thus restricting it to right or left handed shooters depending on which side the rod, 19, is inserted.

Figure 9:
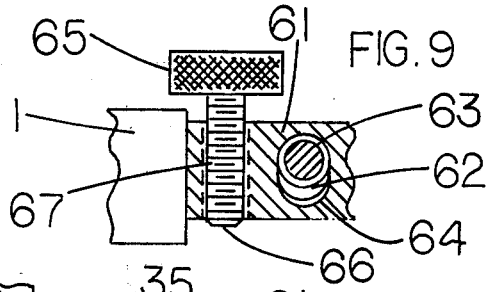
FIG. 9 is a sectional view of an alternate embodiment of part of the sight shown in FIG. 1.

Another embodiment contemplated herein is that shown in FIG. 9, which is another alternate to vary the means of vertical adjustment. In place of block, 13, block, 61, is substituted. Lead screw, 12, passes through hole, 62, in block, 61, which is partially threaded, 64, and partially clear, 63. To engage block, 61, with lead screw, 12, one simply tightens knob, 65, on screw, 66, in threaded hole, 67, in block, 61, which when knob, 65, contacts housing, 11, draws block, 61, into engagement with screw, 12. For coarse adjustment, one simply loosens knob, 65, and block, 61, disengages from lead screw, 12.

Another feature shown in FIG. 1, is the daily condition point marker, 69, Marker, 69, is adjustably mounted in groove, 74, in block, 13, by means of knob, 72, on threaded shaft, 71, in threaded hole, 70, in block, 13. Indicator, 73, on marker, 69, provides reference means relating the position of block, 13, and thus marker, 20, with respect to housing, 11. By setting indicator, 73, on specific points on yardage marker, 68, the range of the bow for pre-determined conditions is established. Yardage marker, 68, which in its preferred embodiment comprises paper, 78, mounted on base, 75, is disposed in channel, 76, in housing, 11, and secured therein by set screw, 77. A particular feature associated with the changeable yardage marker, 68, is that device, 1, may be mounted on a bow on a given day and if a yardage marker is marked for various limbs the bow is then ready for immediate use as the limbs are changed by changing the yardage marker.

While I have illustrated and described the preferred embodiments of my invention, it is to be understood that changes and modifications in the form, construction, arrangement and combination of the parts and steps of the Bow Sight and methods of making and using the same may be substituted for those herein shown and described without departing from the nature and principle of my invention.

Having thus described my invention, what I claim as new and desire to secure by United States Letters Patent is:

1. In a bow sight for an archery bow having an elongated support member mounted on said bow and extending in the general direction of the target, and a sight assembly carried by said elongated support member, said sight assembly including a housing disposed generally vertically, a lead screw mounted at its ends on the housing and spaced therefrom between said ends, and a sight block embracing said lead screw but slidably mounted with respect thereto, the improvement comprising a plunger reciprocably mounted in said sight block, said plunger having at one end means for engaging said lead screw, and a spring mounted to bias said plunger and engaging means linearly toward engagement with said lead screw, the other end of said plunger being manipulable to reciprocate said plunger between positions of engagement of said lead screw engagement means with said lead screw and non-engagement therewith.

2. The improvement of claim 1 wherein the means on said plunger for engaging the lead screw comprises a rack block with a passage extending through it, said lead screw extending through said passage, one portion of the surface defining said passage being threaded complementarily to said lead screw for engagement therewith, said passage being of a size to permit said lead screw to clear said threaded portion when said plunger and rack block are moved away from engaging position against the bias of said spring.

3. The improvement of claim 2 wherein the threaded portion of said rack block for engagement with said lead screw is on the side of the lead screw toward the outer end of said plunger.

4. The improvement of claim 2 wherein the threaded portion of said rack block for engagement with said lead screw is on the side of the lead screw away from the outer end of said plunger.

5. In a bow sight for an archery bow having an elongated support member mounted on said bow and extending in the general direction of the target, and a sight assembly carried by said elongated support member, said sight assembly including a housing disposed generally vertically, a lead screw mounted at its ends on the housing and spaced therefrom between said ends, a sight block mounted for translation along and with respect to said lead screw, and a yardage guide mounted on said sight assembly housing substantially parallel to said lead screw, the improvement comprising a marker, mounted on said sight block for selective adjustment relative to said sight block in a direction substantially parallel to said lead screw and having an indicator in correlative position with said yardage guide, said marker being in the form of an L-shaped rod, said sight block having a shallow groove in it parallel to the lead screw axis, one of the legs of the L-shaped rod being seated in said groove and the other extending to a point adjacent said yardage guide, and means carried by said sight block for holding said marker in chosen position, said housing having an elongated recess forming a yardage guide seat parallel to the lead screw, said yardage guide being in the form of an elongated self-supporting strip of a shape complementary to that of the said seat and selectively removably seated therein, and means, carried by said housing, for locking said strip in said recess.

6. The improvement of claim 5 wherein the means for locking said strip comprise at least one set screw engaging an end of said strip.

7. In a bow sight for an archery bow having an elongated support member mounted on said bow and extending in the general direction of the target, and a sight assembly carried by said elongated support member, said sight assembly including a housing disposed generally vertically, a lead screw mounted at its ends on the housing and spaced therefrom between said ends, and a sight block mounted for translation with respect to said lead screw, the improvement comprising a sighting rod assembly mounted in said sighting block at right angles to the axis of said lead screw, said sighting rod assembly comprising a tubular, open-ended sight rod housing non-rotatably mounted in a passage in said sight block transverse to the axis of said lead screw and means for selectively releasably locking said housing against translation therefrom; a bushing mounted in said housing against rotation but for translation with respect thereto; a sighting rod extending through said bushing and locked against movement with respect thereto, said sighting rod having a sight marker end projecting from one end of said housing and a threaded shank portion projecting from the opposite end of said housing; a spring, caged between said bushing and a shoulder in said housing, biasing the said bushing, hence the said sighting rod in a direction toward the sight marker end of the housing, and an internally threaded knob threadedly engaging the projecting threaded shank of said sighting rod and bearing against an end of said sight rod housing whereby rotation of the said knob produces translation of said sighting rod and bushing with respect to said sight rod housing.

* * * * *